US010796861B2

(12) United States Patent
Chen et al.

(10) Patent No.: US 10,796,861 B2
(45) Date of Patent: Oct. 6, 2020

(54) KEY MODULE

(71) Applicants: LITE-ON ELECTRONICS (GUANGZHOU) LIMITED, Guangzhou (CN); Lite-On Technology Corporation, Taipei (TW)

(72) Inventors: Chun-Lin Chen, Taipei (TW); Ko-Hsiang Lin, Taipei (TW); Jui-Yu Wu, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 16/183,763

(22) Filed: Nov. 8, 2018

(65) Prior Publication Data

US 2019/0164700 A1 May 30, 2019

Related U.S. Application Data

(60) Provisional application No. 62/591,705, filed on Nov. 28, 2017.

(30) Foreign Application Priority Data

Aug. 22, 2018 (CN) ..... 2018 1 0959340

(51) Int. Cl.
*H01H 13/20* (2006.01)
*H01H 13/14* (2006.01)
(Continued)

(52) U.S. Cl.
CPC ..... *H01H 13/20* (2013.01); *H01H 3/125* (2013.01); *H01H 13/04* (2013.01); *H01H 13/14* (2013.01);
(Continued)

(58) Field of Classification Search
CPC .... H01H 13/20; H01H 13/04; H01H 13/7065; H01H 13/14; H01H 2233/07
(Continued)

(56) References Cited

U.S. PATENT DOCUMENTS 7,449,651 B2 * 11/2008 Lin ..... H01H 3/125 200/344
8,759,702 B2 * 6/2014 Huang ..... H01H 3/125 200/314
(Continued)

FOREIGN PATENT DOCUMENTS

| | | |
|---|---|---|
| CN | 103065849 | 4/2013 |
| CN | 104576134 | 4/2015 |
| CN | 106803469 | 6/2017 |

OTHER PUBLICATIONS

"Office Action of Taiwan Counterpart Application," dated May 1, 2019, p. 1-p. 5.
(Continued)

*Primary Examiner* — Edwin A. Leon
*Assistant Examiner* — Lheiren Mae A Caroc
(74) *Attorney, Agent, or Firm* — JCIPRNET

(57) ABSTRACT

A key module including a key cap, a bottom plate, and a scissors structure is provided. The scissors structure has a first supporting member and a second supporting member pivoted to the key cap and the bottom plate respectively. The first supporting member has a plurality of protruding shafts, the second supporting member has a plurality of axle holes, and the protruding shafts are movably pivoted to the axle holes respectively.

11 Claims, 11 Drawing Sheets

(51) Int. Cl.
*H01H 13/7065* (2006.01)
*H01H 13/04* (2006.01)
*H01H 3/12* (2006.01)

(52) U.S. Cl.
CPC ... *H01H 13/7065* (2013.01); *H01H 2215/042* (2013.01); *H01H 2233/07* (2013.01)

(58) Field of Classification Search
USPC ..... 200/344
See application file for complete search history.

(56) References Cited

U.S. PATENT DOCUMENTS

2011/0268487 A1* 11/2011 Larsen ..... G06F 3/0202
400/490
2016/0055989 A1* 2/2016 Hsu ..... H01H 13/14
200/344

OTHER PUBLICATIONS

"Office Action of China Counterpart Application," dated Oct. 8, 2019, p. 1-p. 6.

* cited by examiner

KEY MODULE

CROSS-REFERENCE TO RELATED APPLICATION

This application claims the priority benefits of U.S. provisional application Ser. No. 62/591,705, filed on Nov. 28, 2017, and China application serial no. 201810959340.5, filed on Aug. 22, 2018. The entirety of each of the above-mentioned patent applications is hereby incorporated by reference herein and made a part of this specification.

BACKGROUND OF THE INVENTION

Field of the Invention

The invention relates to a key module.

Description of Related Art

Keyboards are indispensable input devices for inputting text, symbols or numbers for personal computers nowadays. However, as the keyboard is developed to become lighter and thinner, its internal space gradually becomes insufficient. Accordingly, there is not enough space to dispose the conventional balance bar structure adapted for force balancing in this internal space, and it is also impossible to provide the required structural strength when a button is pressed.

Moreover, the trend toward lighter and thinner keyboards also results in apparently insufficient actuation stroke when a button of the keyboard is pressed. Therefore, when a user presses the button of the existent lightweight keyboard, it is not easy for the user to feel a sufficient pressing force by hand.

Therefore, an important issue that needs to be addressed in the current field is how to provide a key module that has sufficient actuation stroke even under the condition of limited internal space and simultaneously has the structural strength and force balance.

SUMMARY OF THE INVENTION

The invention proposes a key module that provides sufficient structural strength and force balance and complies with internal space requirements for a lightweight keyboard.

The key module of the invention includes a key cap, a bottom plate and a scissors structure. The scissors structure has a first supporting member and a second supporting member pivoted to the key cap and the bottom plate respectively. The first supporting member has a plurality of protruding shafts, the second supporting member has a plurality of axle holes, and the plurality of protruding shafts are movably pivoted to the plurality of axle holes respectively.

In an embodiment of the invention, the key module further includes a membrane circuit board and an elastic member. The membrane circuit board is disposed on the bottom plate. The elastic member is located between the key cap and the membrane circuit board. A part of the first supporting member and a part of the second supporting member are each pivoted to the bottom plate.

In an embodiment of the invention, the first supporting member has a first body and a plurality of first extending portions, the first body is pivoted to the key cap, and the plurality of first extending portions extend from the first body toward the second supporting member and are pivoted to the bottom plate. The second supporting member has a second body and a plurality of second extending portions, the second body is pivoted to the key cap, and the plurality of second extending portions extend from the second body toward the first supporting member and are pivoted to the bottom plate. The plurality of first extending portions and the plurality of second extending portions are intersected with each other.

In an embodiment of the invention, the plurality of first extending portions respectively have the plurality of protruding shafts, and the plurality of second extending portions respectively have the plurality of axle holes. The plurality of first extending portions and the plurality of second extending portions are slidably pivoted together where they intersect by the plurality of protruding shafts and the plurality of axle holes.

In an embodiment of the invention, wherein an extending direction of the axle hole is consistent with an extending axial direction of the first extending portion or an extending axial direction of the second extending portion.

In an embodiment of the invention, each of the first supporting member and the second supporting member has at least one light transmission hole.

In an embodiment of the invention, the scissors structure is pivoted to the key cap and to the bottom plate in the same axial direction, and is in a pivoting state without displacement.

In an embodiment of the invention, pivoting joints of the scissors structure and the key cap or pivoting joints of the scissors structure and the bottom plate are symmetrically disposed with respect to the protruding shafts or the axle holes.

In an embodiment of the invention, at least one of the first supporting member and the second supporting member includes a magnetic attraction member, and the bottom plate further includes a magnetic generation member corresponding to the magnetic attraction member.

In an embodiment of the invention, the first supporting member and the second supporting member have a first material and a second material respectively, and the first material either partially covers the second material or surroundingly disposed on the second material.

In an embodiment of the invention, the first material is an elastic material, and the second material is a magnetic attraction material.

In an embodiment of the invention, the key module is a multiple key.

Based on the foregoing description, in the key module, the first supporting member and the second supporting member of the scissors structure are respectively pivoted to the key cap and the bottom plate, so that the first supporting member and the second supporting member are combined with each other by the matching between the protruding shaft and the axle hole. As a result, when the status of the scissors structure is changed, the first supporting member and the second supporting member pivot and slide simultaneously by means of the protruding shaft and the axle hole. Accordingly, since pivoting and sliding are performed at the intermediate section of the first supporting member and the second supporting member, and since the pivoting joint between the scissors structure and the key cap and the pivoting joint between the scissors structure and the bottom plate are respectively located at the opposite sides on the intermediate section (that is, the pivoting joint between the scissors structure and the key cap and the pivoting joint between the scissors structure and the bottom plate are symmetrically disposed with respect to the intermediate section), no matter which part of the key cap is pressed, a uniform torque may be formed with respect to the intermediate section due to the foregoing configuration. Consequently, the dynamic balance of the scissors structure during the change of status may still be maintained so as to prevent the skewing of the key cap, and the user has a good hand feel when pressing the buttons with sufficient force even under the condition of limited space and limited pressing stroke.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1A:
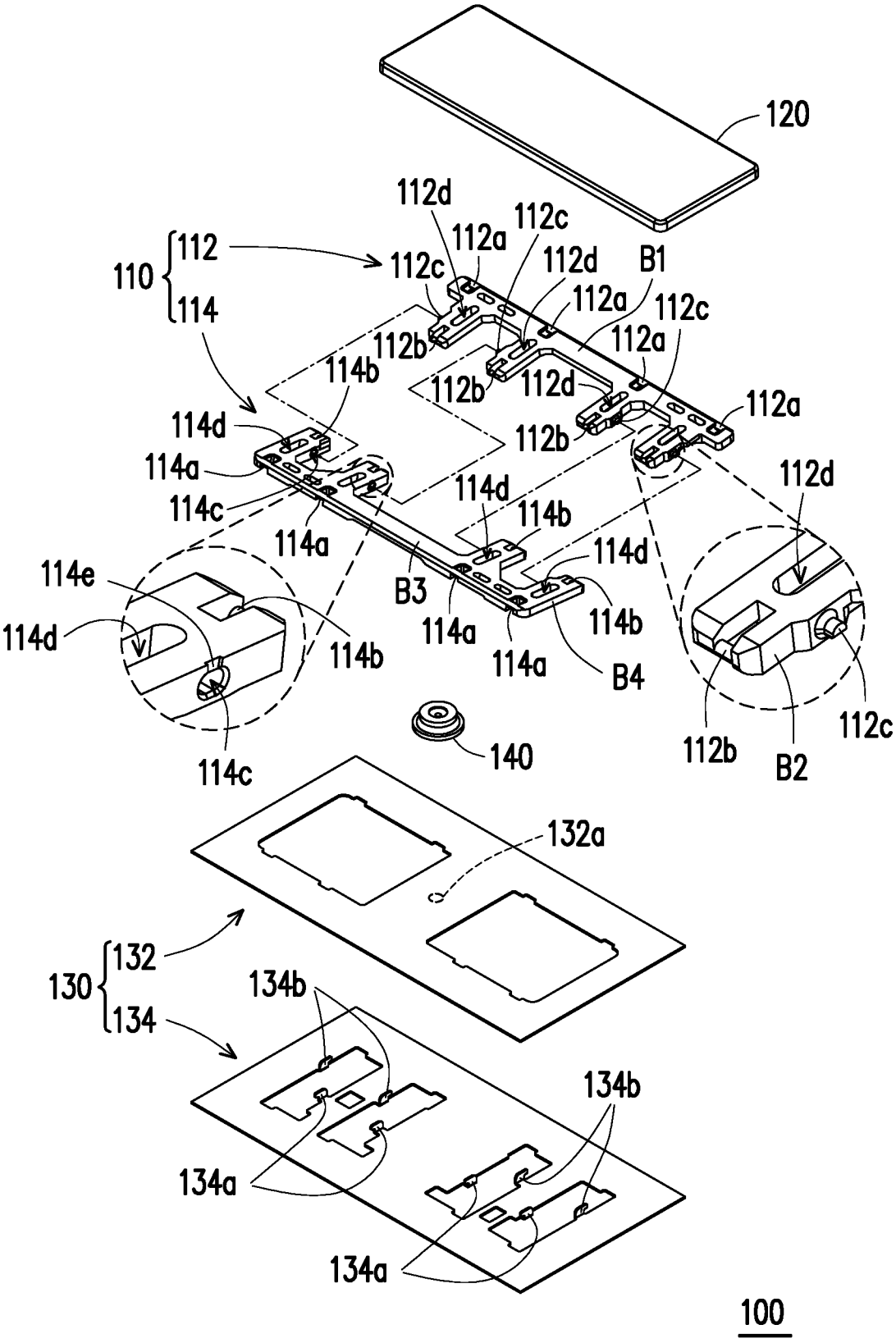
FIG. 1A is an exploded view of a key module according to an embodiment of the invention.
Figure 2:
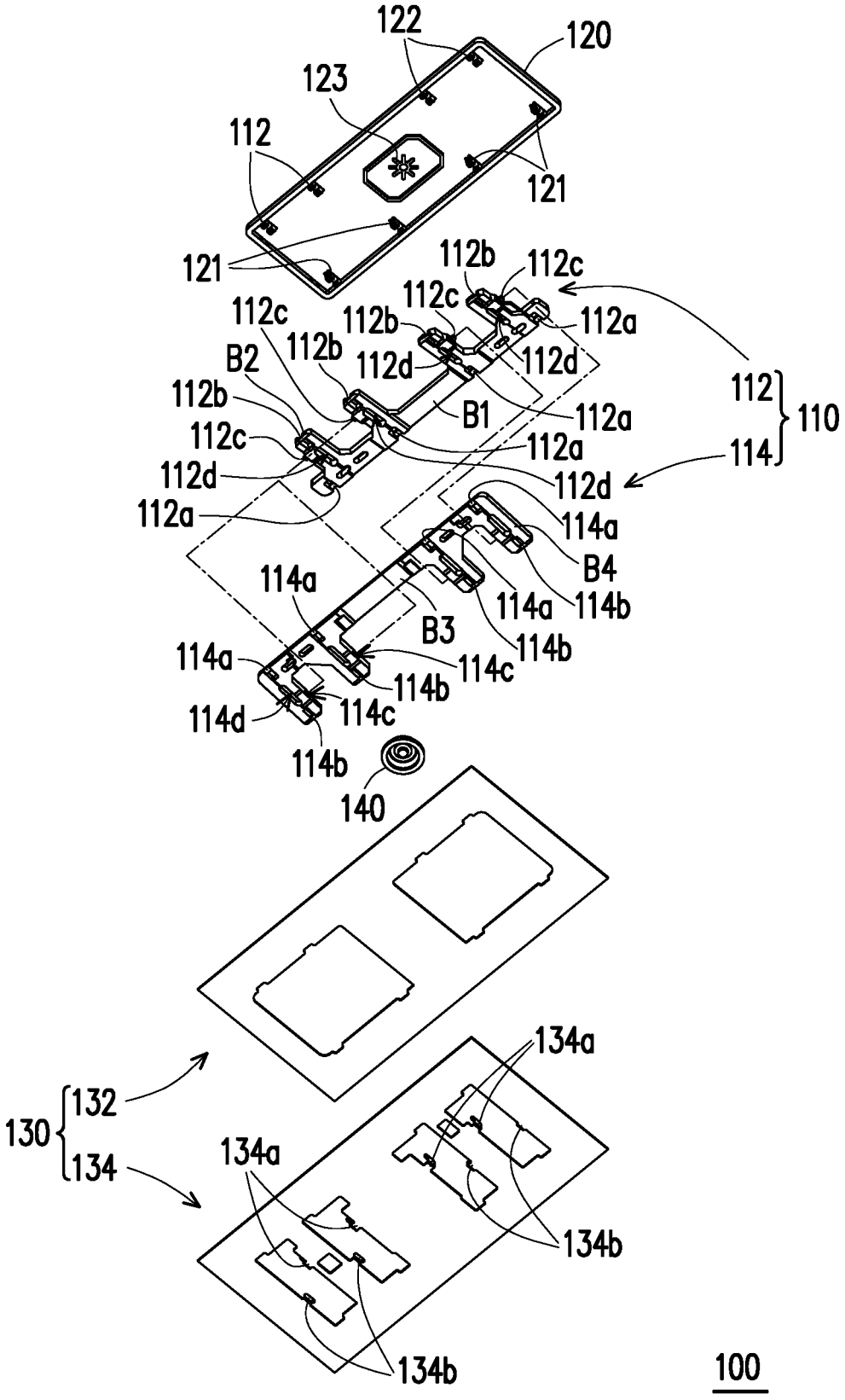
FIG. 2 illustrates the key module of FIG. 1A from another perspective.
Figure 3:
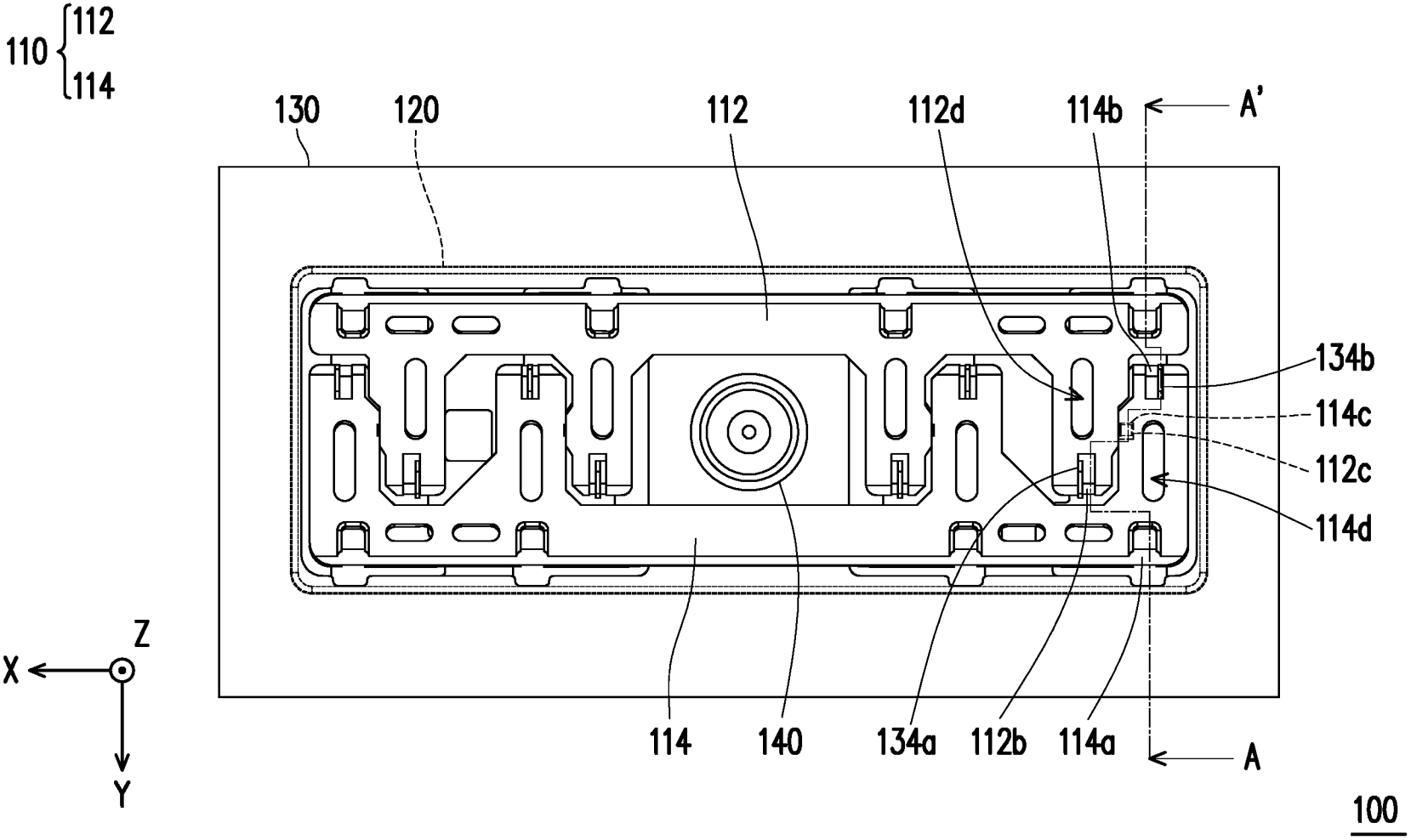
FIG. 3 is a top view of the key module of FIG. 1A in an assembled state.

FIG. 1A is an exploded view of a key module according to an embodiment of the invention. FIG. 2 illustrates the key module of FIG. 1A from another perspective. FIG. 3 is a top view of the key module of FIG. 1A in an assembled state, wherein the key cap is shown in a perspective manner with dotted lines to facilitate identification of other components obscured by the key cap. Referring to FIG. 1A, FIG. 2 and FIG. 3 simultaneously, in this embodiment, a key module 100 is a multiple key, and includes a key cap 120, a base 130 and a scissors structure 110. The scissors structure 110 includes a first supporting member 112 and a second supporting member 114 pivoted to the key cap 120 and the base 130 respectively. The first supporting member 112 has protruding shafts 112*c*, the second supporting member 114 has axle holes 114*c*, and the protruding shafts 112*c* are movably pivoted to the axle holes 114*c* corresponding. Depending on whether being pressed by a force or not, the key cap 120 is adapted to move toward the base 130 or away from the base 130 so as to change the status of the scissors structure 110. When the status of the scissors structure 110 is changed, due to the mutual matching between the protruding shaft 112*c* and the axle hole 114*c*, the first supporting member 112 and the second supporting member 114 pivot and slide with respect to each other.

In addition, the key module 100 further includes an elastic member 140, such as a rubber dome. The base 130 includes a membrane circuit board 132 and a bottom plate 134 that are stacked with each other. The elastic member 140 is located between the key cap 120 and the membrane circuit board 132, and a part of the first supporting member 112 and a part of the second supporting member 114 are each pivoted to the bottom plate 134. When pressed by a force, the key cap 120 is moved toward the base 130 to press and deform the elastic member 140 by means of a driving rib 123 of the key cap 120, so that the deformed elastic member 140 may further lean against the membrane circuit board 132 to trigger a trigger couple 132*a* of the membrane circuit board 132. As a result, the operation of the key module 100 generates an electrical signal to be sent to the control system, thereby achieving the predetermined function of the key module 100. Once the force is released, the triggering state of the trigger couple 132*a* is also released, and the elastic member 140, by its elastic (restoring) force, drives the key cap 120 to return to the original position to be restored.

Furthermore, as shown in FIG. 1A and FIG. 2, the first supporting member 112 and the second supporting member 114 each form a grid-like branch structure. The first supporting member 112 has a first body B1 and at least one first extending portion (exemplified as a plurality of first extending portions B2 in this embodiment, but not limited thereto). The first body B1 is provided with a plurality of pivots 112*a* for pivoting to a plurality of locking portions 121 of the key cap 120. The first extending portions B2 extend from the first body B1 toward the second supporting member 114, and are pivoted to a plurality of restricting portions 134*a* of the base 130 (the bottom plate 134) by a plurality of pivots 112*b*. Accordingly, one side of the key cap 120 may be coupled to the base 130 by the first supporting member 112 to form a linkage mechanism. In contrast, the second supporting member 114 has a second body B3 and at least one second extending portion (exemplified as a plurality of second extending portions B4 in this embodiment, but not limited thereto). The second body B3 is provided with a plurality of pivots 114*a* for pivoting to a plurality of locking portions 122 of the key cap 120. The second extending portions B4 extend from the second body B3 toward the first supporting member 112, and are pivoted to a plurality of restricting portions 134*b* of the base 130 (the bottom plate 134) by a plurality of pivots 114*b*. Accordingly, the other side of the key cap 120 may be coupled to the base 130 by the second supporting member 114 to form another linkage mechanism. Herein the first extending portions B2 and the second extending portions B4 are intersected with each other.

Moreover, the bottom plate 134 is made of a metal plate, for example. The restricting portion 134*a* and the restricting portion 134*b* are formed by stamping and bending from the metal plate, for example, and have inverted L-shaped hook profiles with openings facing away from each other. The restricting portion 134*a* and the restricting portion 134*b* pass through an opening of the membrane circuit board 132 to exert pivoting and limiting effects on the pivot 112*b* of the first supporting member 112 and the pivot 114*b* of the second supporting member 114 respectively.

Figure 4:
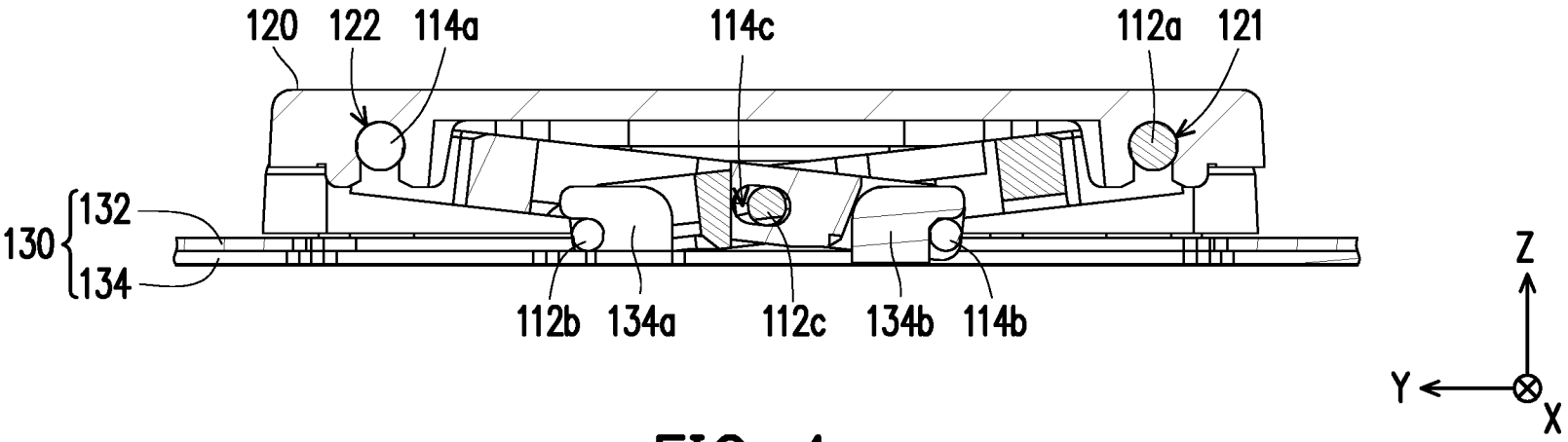
FIG. 4 and FIG. 5 are partial cross-sectional views of the key module in different states.
Figure 5:
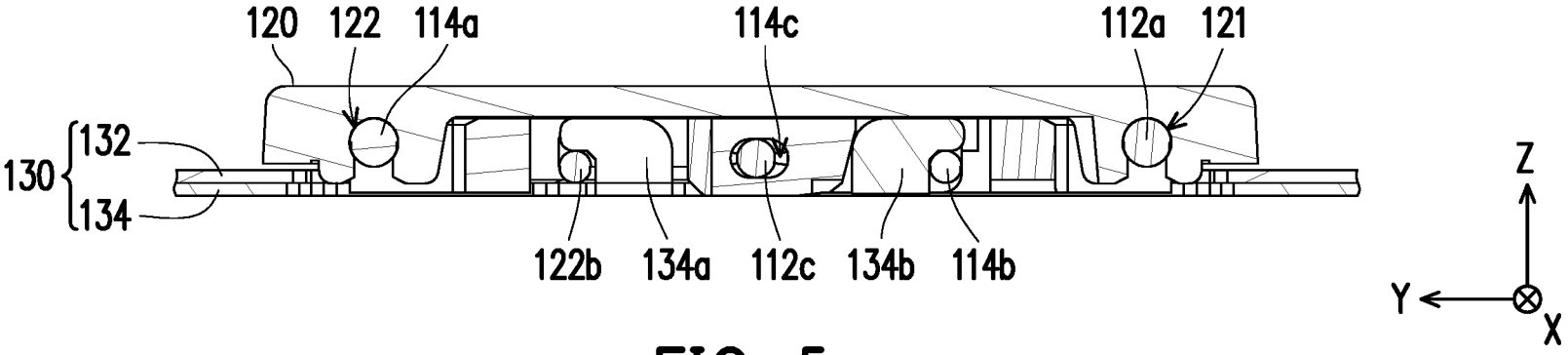

FIG. 4 and FIG. 5 are partial cross-sectional views of the key module in different states. Referring to FIG. 1A, FIG. 4 and FIG. 5, each of FIG. 4 and FIG. 5 is a cross-sectional view of FIG. 3 taken along the line A-A', wherein a rectangular coordinates X-Y-Z are provided to facilitate component description. In this embodiment, the first extending portion B2 has the protruding shaft 112*c* located at an intermediate section of the first extending portion B2, and the second extending portion B4 has the axle hole 114*c* located at an intermediate section of the second extending portion B4. The extending direction of the axle hole 114*c* is consistent with the extending axial direction of the second extending portion B4. Accordingly, the first extending portions B2 and the second extending portions B4 may be slidably pivoted together where they intersect by the protruding shafts 112*c* and the axle holes 114*c*.

In other words, the scissors structure 110 composed of the first supporting member 112 and the second supporting member 114 is substantially pivoted to the key cap 120 and to the base 130 in the same axial direction (both about the X axis), and is in a pivoting state without displacement. That is, between the scissors structure 110 and the key cap 120 and between the scissors structure 110 and the base 130 only exists a single degree of freedom (i.e., they pivot about the X axis only). Instead, a lateral sliding (in the pressing state as shown in FIG. 5, the axle hole 114*c* substantially extends along the Y axis) in the pivoting state is generated by the matching between the protruding shaft 112*c* and the axle hole 114*c*, so that the scissors structure 110 may operate smoothly.

As shown in FIG. 1A, for the purpose of facilitating assembly, the second supporting member 114 in this embodiment further has a guiding portion 114*e* disposed on the second extending portion B4 and communicating with the axle hole 114*c*, so that the protruding shaft 112*c* may pass through the guiding portion 114*e* during assembly to be smoothly moved into the axle hole 114*c*.

Meanwhile, it can be further known in light of FIG. 4 and FIG. 5 that the pivoting joint of the scissors structure 110 and the key cap 120 and the pivoting joint of the scissors structure 110 and the base 130 are symmetrically disposed with respect to the protruding shaft 112*c* or the axle hole 114*c*. In this way, when the key cap 120 is pressed, a uniform torque may be formed at both the pivoting joints in the intermediate sections of the first supporting member 112 and the second supporting member 114, so that the force on the scissors structure 110 is dynamically balanced when the status is changed. As a result, skewing caused by an uneven force may be avoided. In particular, in the case where the key module 100 is applied to some multiple keys with longer lengths or even irregular shapes (e.g., function keys such as SPACE, SHIFT, BACKSPACE and ENTER), operational stability may be further improved because of the aforementioned structural configuration. Compared with conventional technology where it is necessary to additionally provide a balance bar to overcome this problem, the same effect can be effectively achieved in this embodiment merely by means of the scissors structure, so that unnecessary components (the balance bar) are eliminated. As a result, the required space and the manufacturing cost of the key module 100 are reduced. At the same time, this configuration also facilitates the application of the key module 100 to a lightweight keyboard.

Figure 6A:
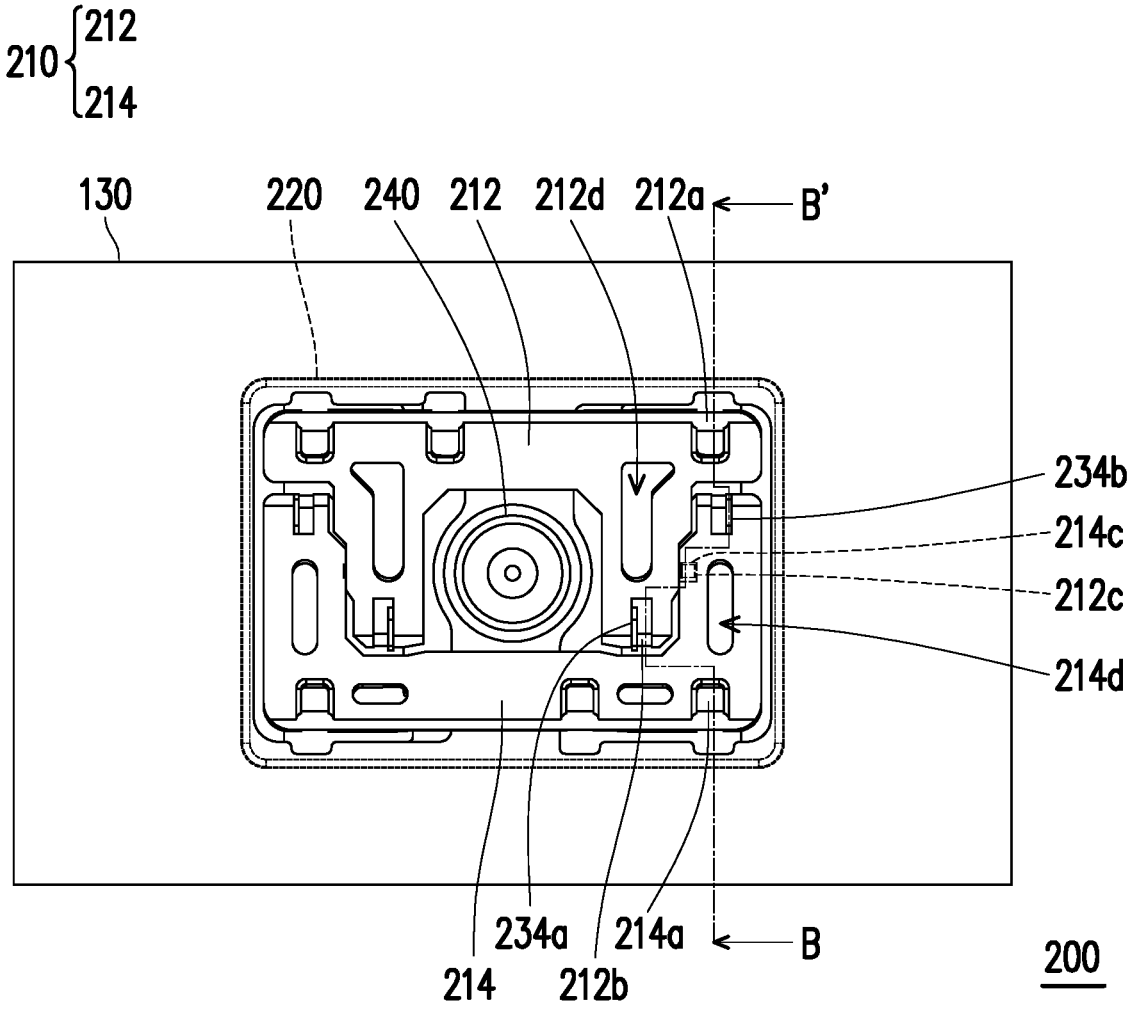
FIG. 6A is a top view of a key module according to another embodiment of the invention.
Figure 7:
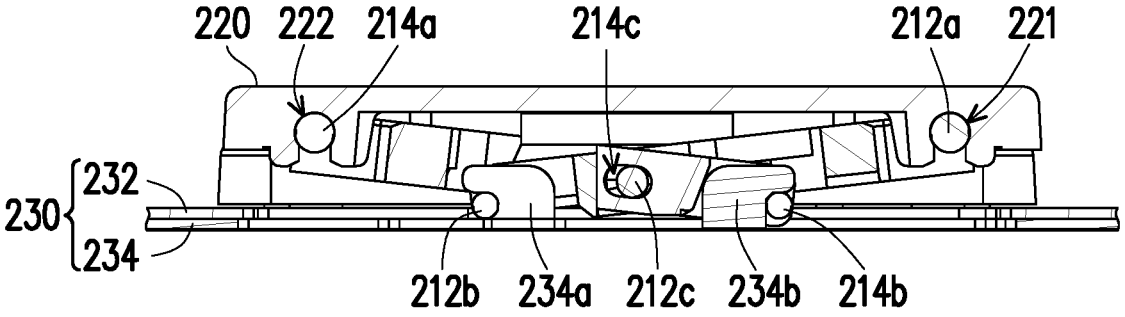
FIG. 7 is a partial cross-sectional view of the key module of FIG. 6A.

FIG. 6A is a top view of a key module according to another embodiment of the invention, wherein the key cap is partially shown in a perspective manner with dotted lines to facilitate identification of other components obscured by the key cap. FIG. 7 is a partial cross-sectional view of the key module of FIG. 6A taken along the line B-B'. In this embodiment, a key module 200 includes a scissors structure 210, a key cap 220, a base 230 and an elastic member 240. The scissors structure 210 includes a first supporting member 212 and a second supporting member 214. The base 230 includes a membrane circuit board 232 and a bottom plate 324. The first supporting member 212 is pivoted to a locking portion 221 of the key cap 220 by a pivot 212*a* thereof, and is pivoted to a restricting portion 234*a* by a pivot 212*b* thereof. The second supporting member 214 is pivoted to a locking portion 222 of the key cap 220 by a pivot 214*a* thereof, and is pivoted to a restricting portion 234*b* by a pivot 214*b* thereof. At the same time, the first supporting member 212 and the second supporting member 214 are slidably coupled to each other by the matching of a protruding shaft 212*c* and an axle hole 214*c*. In other words, the key module 200 of this embodiment has substantially the same structural connection relationship as in the foregoing embodiment. As shown in FIG. 6A, different from the foregoing embodiment, the first supporting member 212 and the second supporting member 214 of the scissors structure 210 of this embodiment have a smaller number of extending portions than in the foregoing embodiment.

In other words, it is clearly known from the foregoing two embodiments that the key module 100 or the key module 200 of the invention may be applied to multiple keys with different lengths, and the designer may adjust the length according to requirements.

It should also be noted that the first supporting members 112 and 212 and the second supporting members 114 and 214 further have light transmission holes 112*d* and 212*d* and light transmission holes 114*d* and 214*d* respectively, so that the light generated from light sources (not shown) disposed on the base 130 and 230 may pass through the light transmission holes 112*d* and 212*d* and the light transmission holes 114*d* and 214*d* and be projected to the key caps 120 and 220 so as to provide illuminable key modules 100 and 200.

Figure 6B:
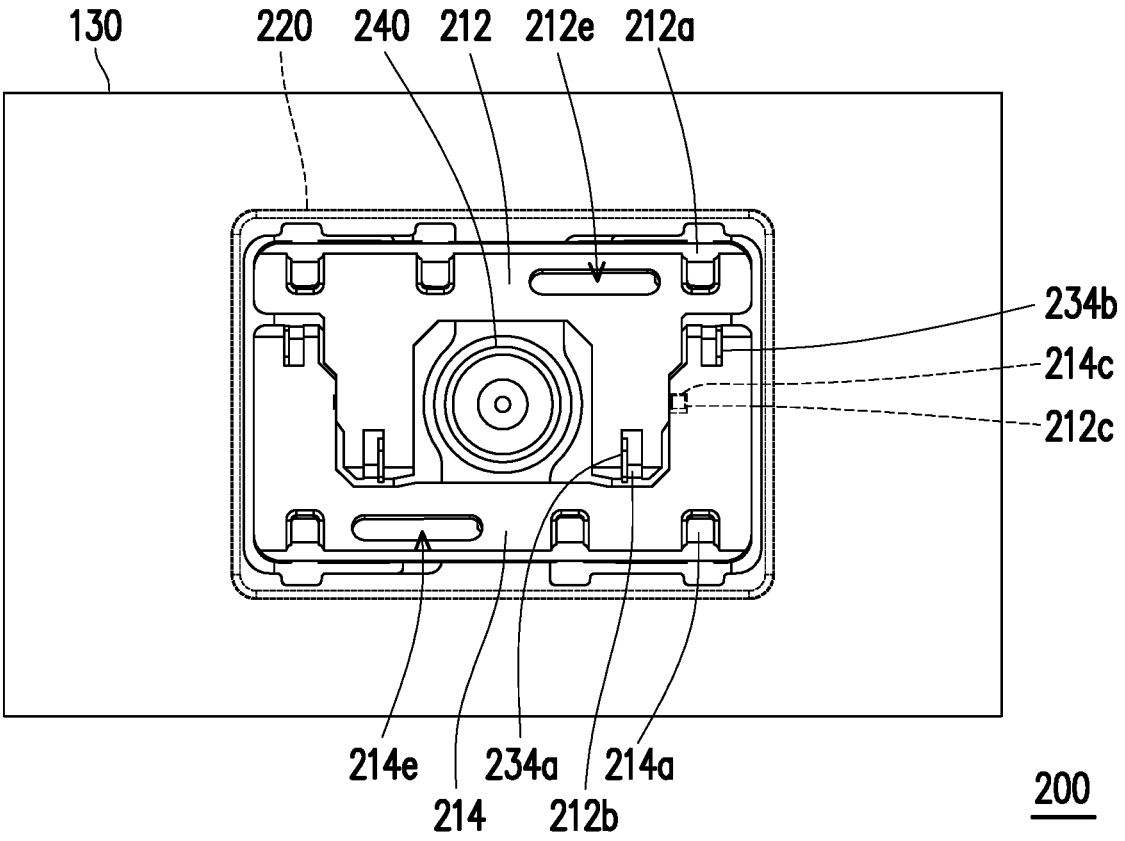
FIG. 6B is a top view of a key module according to another embodiment of the invention.

FIG. 6B is a top view of a key module according to another embodiment of the invention. Different from the foregoing embodiment, the first supporting member 212 and the second supporting member 214 have only one light transmission hole 212*e* and only one light transmission hole 214*e* respectively, which are substantially located at a first body of the first supporting member 212 and a second body of the second supporting member 214 respectively.

Figure 8:
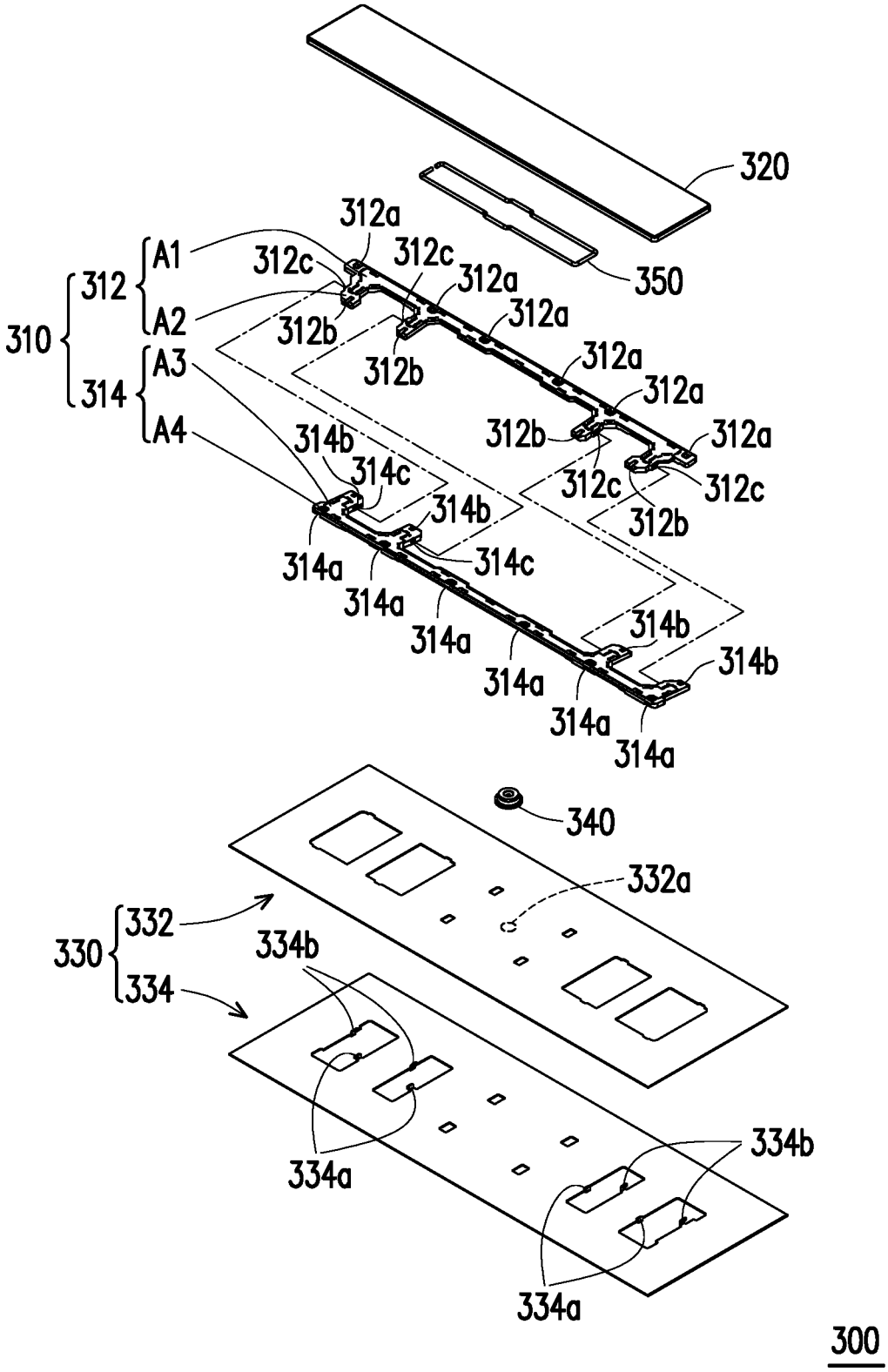
FIG. 8 is an exploded view of a key module according to another embodiment of the invention.
Figure 9:
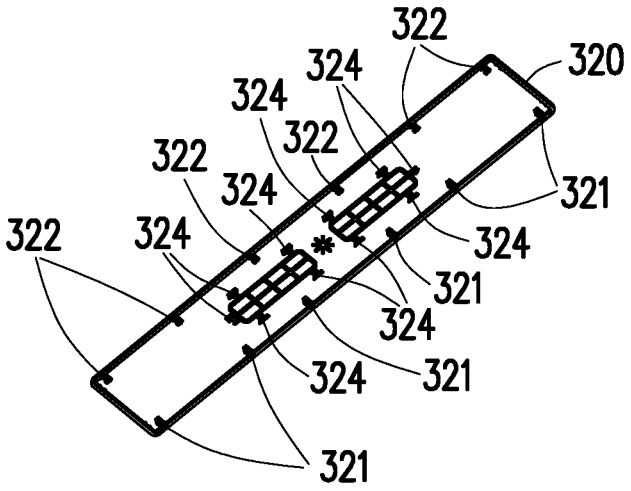
FIG. 9 illustrates the key cap of FIG. 8 from another perspective.

FIG. 8 is an exploded view of a key module according to another embodiment of the invention. FIG. 9 illustrates the key cap of FIG. 8 from another perspective. In this embodiment, a key module 300 includes a scissors structure 310, a key cap 320, a base 330 and an elastic member 340. The scissors structure 310 includes a first supporting member 312 and a second supporting member 314. The base 330 includes a membrane circuit board 332 and a bottom plate 324. The first supporting member 312 is pivoted to a locking portion 321 of the key cap 320 by a pivot 312*a* thereof, and is pivoted to a restricting portion 334*a* by a pivot 312*b* thereof. The second supporting member 314 is pivoted to a locking portion 322 of the key cap 320 by a pivot 314*a* thereof, and is pivoted to a restricting portion 334*b* by a pivot 314*b* thereof. At the same time, the first supporting member 312 and the second supporting member 314 are slidably coupled to each other by the matching of a protruding shaft 312*c* and an axle hole 314*c*. It is clearly known that the components and the connection relationship in this embodiment are substantially the same as those in the foregoing embodiment.

However, different from the embodiments shown in FIG. 1A to FIG. 7 where the first supporting members 112 and 212 and the second supporting members 114 and 214 are each made of a plastic material by an injection molding process, the first supporting member 312 and the second supporting member 314 in this embodiment are respectively made of different portions having different materials. The first supporting member 312 includes portions A1 and A2 that are made of different materials, and the second supporting member 314 includes portions A3 and A4 that are made of different materials. Herein the portion A1 and the portion A3 are made of a metal material, for example, and are surrounded by the portion A2 and the portion A4 made of a plastic material, for example, by means of a buried injection process. That is to say, the portions A1 and A3 having higher rigidity and structural strength serve as the main structure, and are covered with the portions A2 and A4 having higher elasticity and flexibility that serve as the surface structure, so that the first supporting member 312 and the second supporting member 314 simultaneously have the characteristics of both of the materials. In this way, even if the key module is applied to multiple keys with longer lengths, the structural strength may still be maintained, so that the key cap 320 is smoothly moved toward the base 330 by means of the scissors structure 310 regardless of which part of the key cap 320 is pressed by the user. As a result, skewing of the key cap 320 may be avoided. At the same time, since the portions A2 and A4 having higher elasticity and flexibility serve as the surface structure of the supporting members, the assembly operation of the components is facilitated, and wear and tear due to the direct contact and interference between the portions A1 and A3 having higher rigidity is therefore prevented.

Figure 1B:
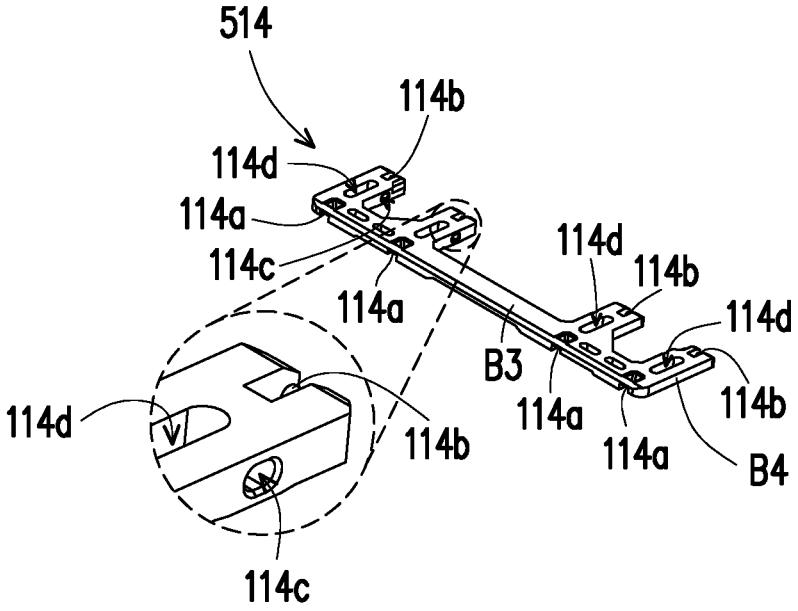
FIG. 1B is a schematic view of a supporting member of a key module according to another embodiment of the invention.

This embodiment does not thus impose limitations on the structure of the supporting member. FIG. 1B is a schematic view of a supporting member of a key module according to another embodiment of the invention. Referring to FIG. 1B, in this embodiment, an axle hole 114*c* of a second supporting member 514 has a closed contour. Since the plastic material has better elasticity and flexibility, the protruding shaft 112*c* may still be smoothly buckled into the axle hole 114*c*. In other words, compared with the second supporting member 114 in the embodiment of FIG. 1A, the second supporting member 514 in this embodiment is not provided with a guiding portion.

Besides, a key module 300 in this embodiment further includes a structural member 350 assembled to a locking portion 324 of a key cap 320 so as to enhance the structural strength of the key cap 320.

Figure 10:
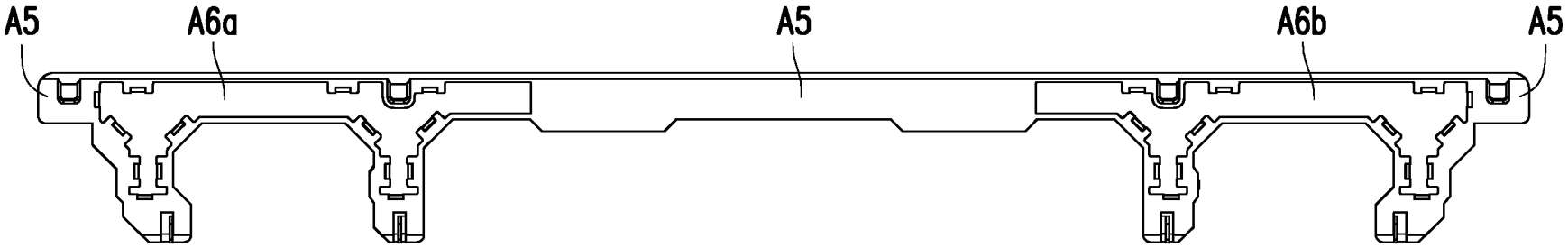
FIG. 10 is a top view of one of the supporting members of a key module according to another embodiment of the invention.

FIG. 10 is a top view of one of the supporting members of a key module according to another embodiment of the invention. Different from the foregoing embodiment, the supporting member in this embodiment includes discontinuous portions A6*a* and A6*b*, which correspond to the aforementioned portions A1 and A3 and are made of a material with higher rigidity. The supporting member also includes a portion A5, which is made of a material with higher elasticity just like the aforementioned portions A2 and A4, and is adapted to cover and surround the periphery of the portions A6*a* and A6*b*. Therefore, the effects described in the foregoing embodiments are still achievable in this embodiment. At the same time, the two embodiments described in FIG. 8 to FIG. 10 may also be further inferred accordingly. The designer may further appropriately adjust the proportion and relative relationship of the portions made of different materials according to the use requirements.

Figure 11:
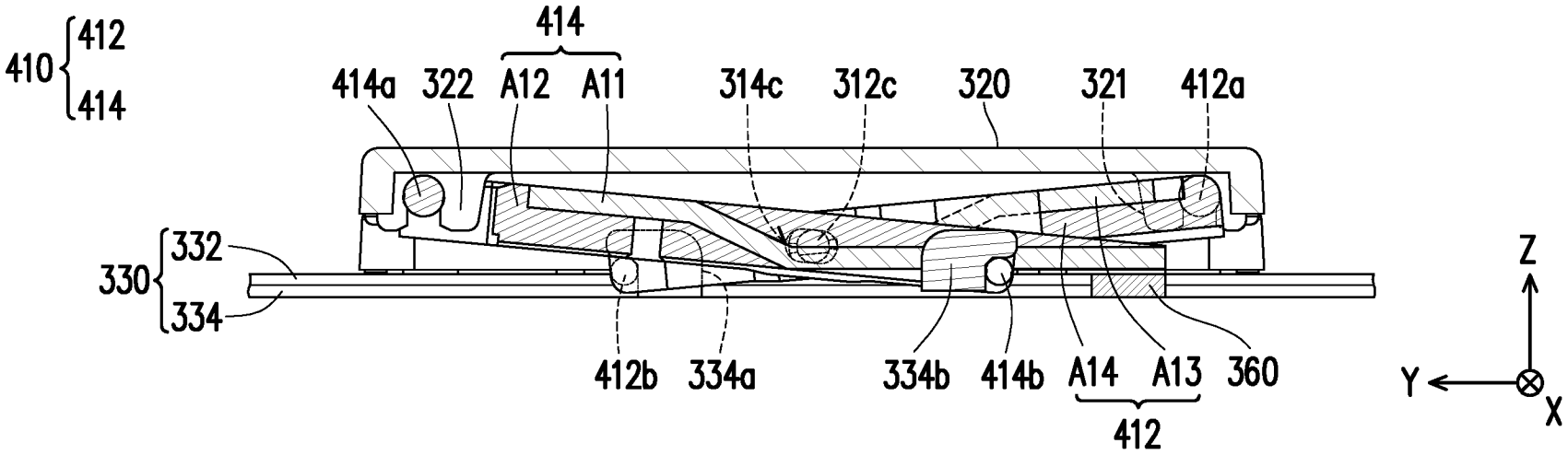
FIG. 11 and FIG. 12 are partial cross-sectional views of a key module in different states according to another embodiment of the invention.
Figure 12:
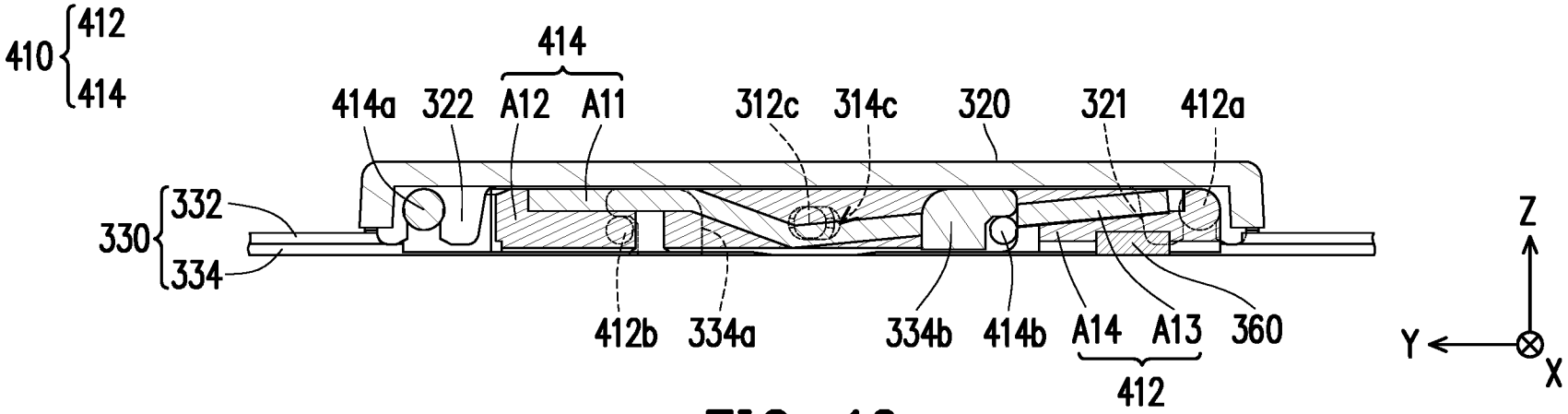

FIG. 11 and FIG. 12 are partial cross-sectional views of a key module in different states according to another embodiment of the invention. It should be noted that the key module in this embodiment is similar to that of FIG. 8 and FIG. 9 above, and the difference therebetween lies in the constituent portions of the supporting member and the configuration relationship of the related components.

Herein a scissors structure 410 includes a first supporting member 412 and a second supporting member 414. The first supporting member 412 is pivoted to a locking portion 321 of a key cap 320 by a pivot 412*a* thereof, and is pivoted to a restricting portion 334*a* of a base 330 by a pivot 412*b* thereof. In contrast, the second supporting member 414 is pivoted to a locking portion 322 of the key cap 320 by a pivot 414*a* thereof, and is pivoted to the restricting portion 334*a* of the base 330 by a pivot 414*b* thereof. At the same time, the first supporting member 412 and the second supporting member 414 are slidably coupled to each other by a protruding shaft 312*c* and an axle hole 314*c*. In other words, the connection relationship between the key cap 320, the scissors structure 410 and the substitute 330 is as shown in the foregoing embodiment.

More specifically, the supporting member in this embodiment is also made of different materials. The first supporting member 412 is composed of a portion A13 and a portion A14 that have different materials, and the second supporting member 414 is composed of a portion A11 and a portion A12 that have different materials. Herein the portion A13 and the portion A11 are, for example, metal materials and have magnetic properties, and the portion A12 and the portion A14, just as the portion A2 and the portion A4 described above, are materials with higher elasticity and flexibility (such as plastic). By means of a buried injection process, the portion A14 covers and surrounds the portion A13, and the portion A12 covers and surrounds the portion A11. Therefore, the scissors structure 410 of this embodiment may also achieve the same effects as in the foregoing embodiments.

It should be noted that since the first supporting member 412 and the second supporting member 414 are structurally symmetrical to each other, only the second supporting member 414 is used for illustration hereinafter. The description of the first supporting member 412 is omitted since it has the same structural configuration.

In this embodiment, as shown by the right sides of FIG. 11 and FIG. 12, the key module further includes a magnetic generation member 360 such as a permanent magnet or an electromagnet. The magnetic generation member 360 is disposed at a membrane circuit board 332 and a bottom plate 334 of the base 330, is located below the second supporting member 414 along the Z axis, and corresponds to the portion A11 of the second supporting member 414 that has magnetic properties (viewed as a magnetic attraction member). Accordingly, as shown in FIG. 11, when the key cap 320 is not pressed by a force, a part of the portion A11 extending to the right side of the pivot 414*b* is magnetically attracted to the magnetic generation member 360, and as shown in FIG. 12, when the key cap 320 is pressed by a force, the part of the portion A11 extending to the right side of the pivot 414*b* is away from the magnetic generation member 360. Therefore, the magnetic attraction between the magnetic generation member 360 and the portion A11 provides the required resistance when the user presses the key module, so that the user may have a good hand feel when pressing the buttons.

In summary, in the key module as shown in the foregoing embodiments of the invention, the first supporting member and the second supporting member of the scissors structure are respectively pivoted to the key cap and the base, so that the first supporting member and the second supporting member are combined with each other by the matching between the protruding shaft and the axle hole. As a result, when the status of the scissors structure is changed, the first supporting member and the second supporting member pivot and slide simultaneously by means of the protruding shaft and the axle hole. Accordingly, no matter which part of the key cap is pressed, due to the foregoing configuration, the dynamic balance of the scissors structure during the change of status may still be maintained so as to prevent the skewing of the key cap. The user thus has a good hand feel when pressing the buttons with sufficient force even under the condition of limited space and limited pressing stroke.

Furthermore, besides being made of a single structure, the scissors structure may also be made of different materials. That is, the portions having higher rigidity and structural strength serve as the main structure, and the portions having higher elasticity and flexibility cover and surround the main structure by means of a buried injection process. In this way, when the key cap is pressed by force, the supporting member may be smoothly moved without skewing due to its rigidity and structural strength. The assembly work of the key module may also be smoothly performed by virtue of the elasticity and flexibility of the surface structure, and the components are prevented from contacting and interfering with each other and causing wear and tear.

Besides, the magnetic generation member may be further disposed at the bottom plate of the key module. The magnetic generation member is located below the supporting member and corresponds to the portion of the supporting member that has magnetic properties. In this way, the magnetic attraction member and the magnetic generation member are attracted to each other when the key module is not pressed by a force. Therefore, when pressing the key cap, the user must overcome the magnetic force in order to smoothly perform the pressing action. As a result, the user has a good hand feel when pressing the key module.

Although the embodiments are already disclosed as above, these embodiments should not be construed as limitations on the scope of the invention. It will be apparent to those skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. A key module, comprising:

a key cap;

a bottom plate; and a scissors structure having a first supporting member and a second supporting member pivoted to the key cap and the bottom plate respectively, wherein the first supporting member has a plurality of protruding shafts, the second supporting member has a plurality of axle holes, and the plurality of protruding shafts are movably pivoted to the plurality of axle holes respectively, wherein the first supporting member has a first body and a plurality of first extending portions, the first body is pivoted to the key cap, and the plurality of first extending portions extend from the first body toward the second supporting member and are pivoted to the bottom plate; the second supporting member has a second body and a plurality of second extending portions, the second body is pivoted to the key cap, and the plurality of second extending portions extend from the second body toward the first supporting member and are pivoted to the bottom plate, wherein the plurality of first extending portions have a first material and a second material, the plurality of second extending portions have the first material and the second material, the first material is different from the second material, and the first material partially covers the second material.

2. The key module according to claim 1, further comprising a membrane circuit board and an elastic member, wherein the membrane circuit board is disposed on the bottom plate, the elastic member is located between the key cap and the membrane circuit board, and a part of the first supporting member and a part of the second supporting member are each pivoted to the bottom plate.

3. The key module according to claim 1, wherein the plurality of first extending portions and the plurality of second extending portions are intersected with each other.

4. The key module according to claim 3, wherein the plurality of first extending portions respectively have the plurality of protruding shafts, the plurality of second extending portions respectively have the plurality of axle holes, and the plurality of first extending portions and the plurality of second extending portions are slidably pivoted together where they intersect by the plurality of protruding shafts and the plurality of axle holes.

5. The key module according to claim 4, wherein the plurality of axle holes have an extending direction respectively, and each of the extending directions is consistent with an extending axial direction of each of the plurality of first extending portions or an extending axial direction of each of the plurality of second extending portions.

6. The key module according to claim 1, wherein each of the first supporting member and the second supporting member has at least one light transmission hole.

7. The key module according to claim 1, wherein the scissors structure is pivoted to the key cap and to the bottom plate in a same axial direction, and is in a pivoting state without displacement.

8. The key module according to claim 7, wherein pivoting joints of the scissors structure and the key cap or pivoting joints of the scissors structure and the bottom plate are symmetrically disposed with respect to the protruding shafts or the axle holes.

9. The key module according to claim 1, wherein at least one of the first supporting member and the second supporting member comprises a magnetic attraction member, and the bottom plate further comprises a magnetic generation member corresponding to the magnetic attraction member.

10. The key module according to claim 1, wherein the first material is a plastic material, and the second material is a metal material.

11. The key module according to claim 1, wherein the key module is a multiple key.

* * * * *